United States Patent [19]

Mihm

[11] 4,155,286

[45] May 22, 1979

[54] WEDGE CLAMP FOR MISSILE LAUNCHER

[76] Inventor: John J. Mihm, 1300 Kirby NE., Albuquerque, N. Mex. 87112

[21] Appl. No.: 856,361

[22] Filed: Dec. 1, 1977

[51] Int. Cl.[2] ..... F41F 7/00

[52] U.S. Cl. ..... 89/1.819; 89/1.5 G

[58] Field of Search ..... 89/1.819, 1.812, 1.806, 89/1.8, 1.5 G; 24/262, 263 A

[56] References Cited

U.S. PATENT DOCUMENTS

| | | | |
|---|---|---|---|
| 2,414,579 | 1/1947 | Anderson et al. | 89/1.819 X |
| 2,993,254 | 7/1961 | Larson | 24/263 A |
| 3,040,629 | 6/1962 | Duncan et al. | 89/1.819 X |
| 3,115,059 | 12/1963 | Moul | 89/1.819 |
| 3,228,297 | 1/1966 | Kossan et al. | 89/1.806 |
| 3,267,809 | 8/1966 | Sikora | 89/1.819 |
| 3,967,529 | 7/1976 | Ingle et al. | 89/1.819 |

*Primary Examiner*—David H. Brown

*Attorney, Agent, or Firm*—Joseph E. Rusz; Richard J. Killoren

[57] ABSTRACT

An adjustable clamp for a missile launcher system having a pair of semi-resilient wedge members which fit between the missile hanger lugs and launcher rail and are drawn into the gap by means of a pair of plate members and a pair of bolts. The Teflon wedges fill the gap between the missile hanger lugs and the launcher rail and reduce vibration during captive flight and protect the rails against damage.

5 Claims, 6 Drawing Figures

WEDGE CLAMP FOR MISSILE LAUNCHER

RIGHTS OF THE GOVERNMENT

The invention described herein may be manufactured and used by or for the Government of the United States for all governmental purposes without the payment of any royalty.

BACKGROUND OF THE INVENTION

This invention relates to a clamp for use with a missile launcher system which reduces vibration during captive flight.

Wingtip missiles on some aircraft are mounted on launcher rails with T-shaped hangers designed for missile launching. Normally the missiles are carried captive during air combat maneuvering training. Launcher snubbers are provided to keep the hangers in contact with the rail. It has been found that deficiencies in the snubbers permit vibrations in the launcher system. Vibration during captive flight causes rail erosion at the missile hangers. Replacement of damaged rails is quite costly. Some means is needed to reduce vibration during captive flight.

BRIEF SUMMARY OF THE INVENTION

According to this invention an adjustable Teflon wedge clamp is positioned around each of the missile hangers and fills the gap between the missile lug and the launcher rail. The wedge clamps eliminate the missile hanger to launcher rail gap and reduce vibration during captive flight.

IN THE DRAWINGS

DETAILED DESCRIPTION OF THE INVENTION

Figure 1:
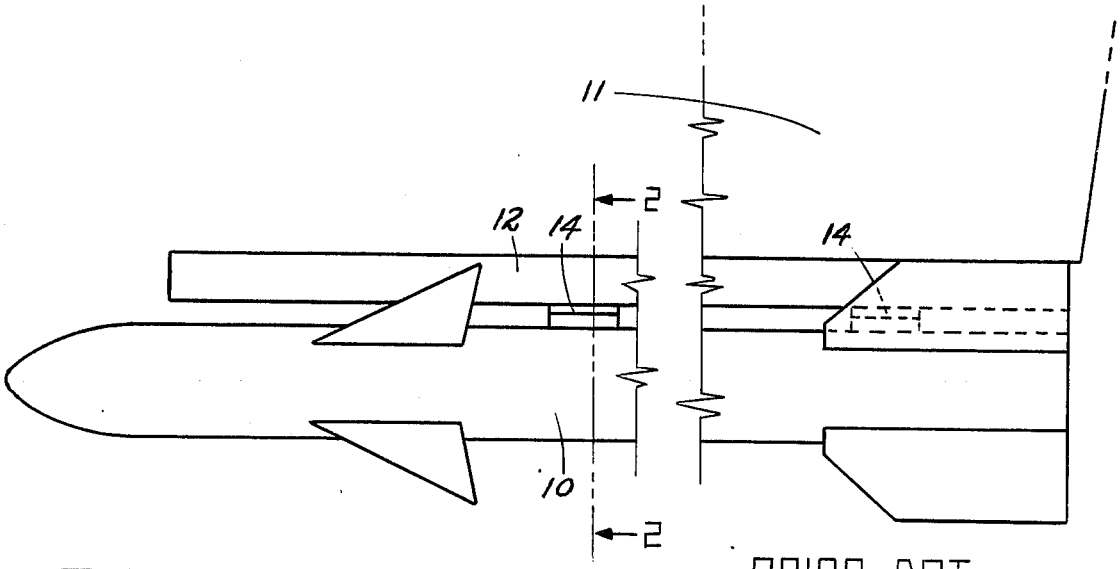
FIG 1 PRIOR ART
FIG. 1 is a schematic view of a conventional launch missile.
Figure 2:
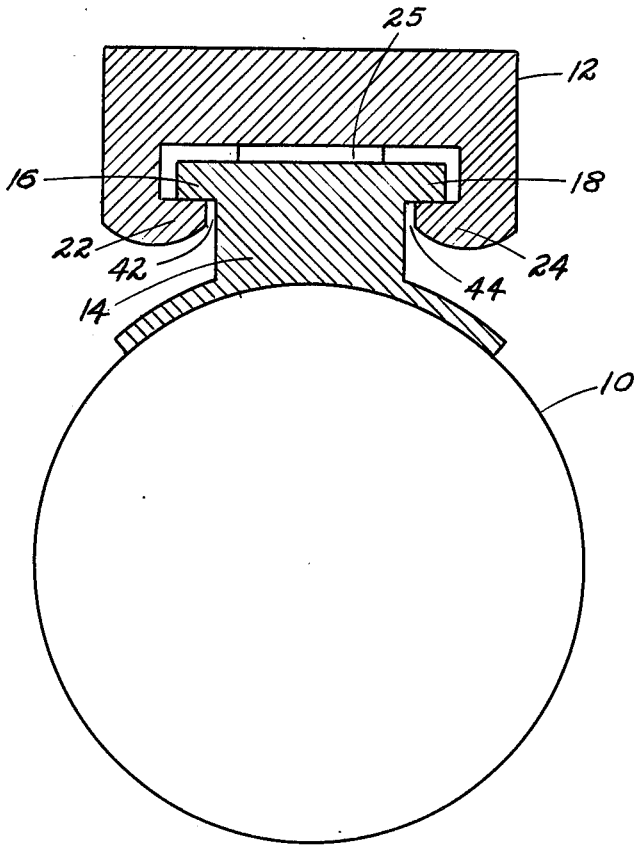
PRIOR ART FIG 2
FIG. 2 is a schematic partial sectional view of a conventional launch rail and missile hanger assembly used in the device of FIG. 1.

Reference is now made to FIG. 1 of the drawing which shows a missile 10, which is normally supported on an aircraft 11, by means of a launch rail 12 and hangers 14, as shown in greater detail in FIG. 2. Flanges 16 and 18 on hangers 14 engage rail track members 22 and 24 with launcher snubbers, such as shown schematically at 25, normally provided to take up slack between the rail and the hangers.

To overcome tension deficiencies in the launcher snubber 25, which permits vibrations between the hangers and the rail, thus causing damage to the rail during captive flight, an adjustable clamp 26 is positioned between the hangers 14 and the rail 12.

Figure 3:
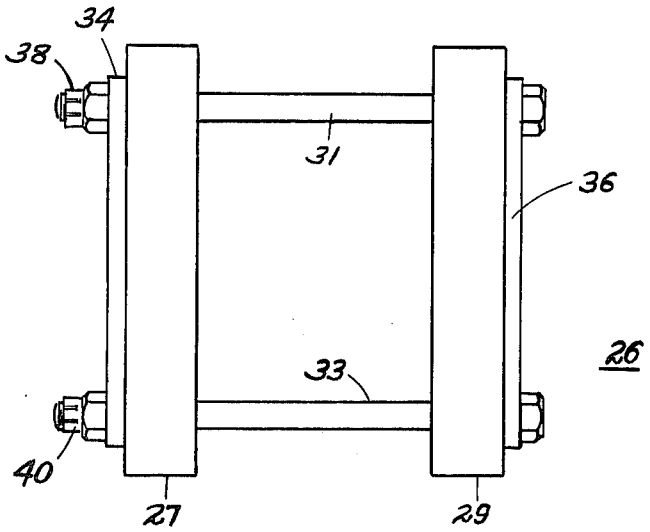
FIG. 3 is a top plan view of a clamp device according to this invention, used with the device of FIGS. 1 and 2.
Figure 4:
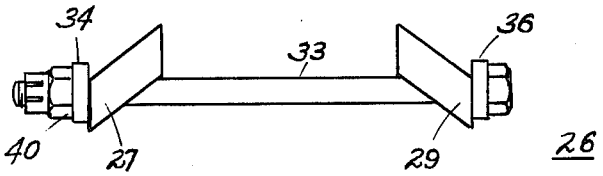
FIG. 4 is a lower end view of the device of FIG. 3.

The wedge clamp members, shown in FIGS. 3 and 4, include two elongated wedge members 27 and 29 with a pair of bolts 31 and 33 passing through holes near opposite ends of wedge members 27 and 29. Support plate members 34 and 36, made of a material such as steel, are positioned on bolts 31 and 33 adjacent to the wedge members 27 and 29.

When the missiles are carried during training flight, the wedge members 27 and 29 can be made of a material such as hard rubber or nylon. When the missile is to be launched, the wedge members must be made of a material with a low coefficient of friction. The material used also should be able to withstand high temperatures above 300° F. Materials which could be used when the missile is to be launched are high temperature semi-resilient solid fluorocarbons with a low coefficient of friction such as polytetrafluoroethylene available under the trademark Teflon.

Figure 5:
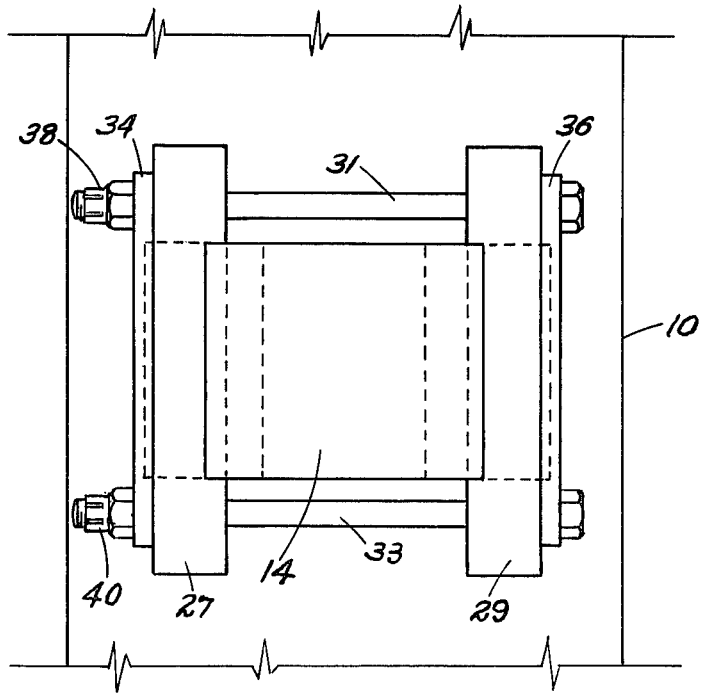
FIG. 5 shows the device of FIG. 3 in position around a missile hanger.
Figure 6:
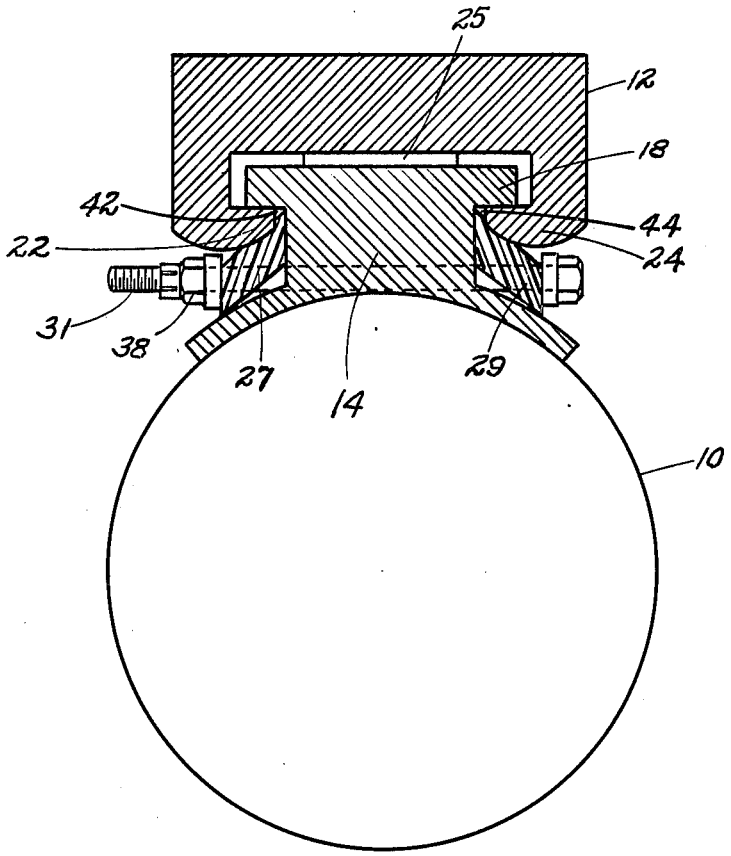
FIG. 6 is a schematic partial sectional view corresponding to FIG. 2 with the clamp device of the invention between the hanger member and launcher rail.

The clamp member is positioned around the hangers 14 and shown in FIG. 5. A pair of self locking nuts 38 and 40 are used to draw the clamp into position between the hangers 14 and the rail 12 so that the clamp wedge material flows into the spaces 42 and 44, as shown in FIG. 6.

In the operation of the device of the invention, after the missile is mounted on rail 12 by means of hangers 14, wedge clamps 26 are positioned around hangers by passing bolts 31 and 33 through plate member 34 and wedge member 27 and then on opposite sides of hangers 14 as shown in FIG. 5. The wedge member 29 and plate member 36 are then placed on the ends of bolts 31 and 33. Self locking nuts 38 and 40 are then threaded onto bolts 31 and 33. Nuts 38 and 40 are then drawn up to wedge the material of members 27 and 29 into spaces 42 and 44, to remove any slack between the rail track members 22 and 24 and the flanges 16 and 18. The nuts should not be drawn too tight so as to draw the hangers too tight against the rail.

There is thus provided a clamp member for use with rail launched missile which reduces vibration damage during captive flight.

I claim:

1. In combination with a missile launch system having the missile supported by means of a plurality of T-shaped hangers on a rail member supported on an aircraft; an apparatus for reducing vibration in the missile launch system during captive flight of the missile, comprising: a pair of elongated semi-resilient members positioned between each of the T-shaped hangers and the rail member; means for wedging the elongated members into the space between the hanger members and the rail member.

2. The device as recited in claim 1 wherein said means for wedging the elongated members into the space between the hanger members and the rail member includes an elongated plate member adjacent each of the elongated semi-resilient members; a first bolt passing through the plate members and the elongated semi-resilient members on one end of each hanger; a second bolt passing through the plate members and the elongated semi-resilient members on the end of each hanger remote from the first bolt; and means threaded onto each bolt for drawing the plate members toward each other to thereby wedge the elongated members into the space between the hanger members and the rail member.

3. The device as recited in claim 2 wherein said means threaded onto the bolts are self-locking nuts.

4. The device as recited in claim 2 wherein said elongated semi-resilient members are made of a high temperature, low coefficient of friction material.

5. The device as recited in claim 4 wherein said semi-resilient members are made of polytetrafluoroethylene.

* * * * *